US007461748B2

(12) United States Patent
Lane et al.

(10) Patent No.: US 7,461,748 B2
(45) Date of Patent: Dec. 9, 2008

(54) HIGH SECURITY DISPLAY SYSTEM FOR RETENTION OF FIREARM

(76) Inventors: Woodrow W. Lane, 2351 Lonestar Dr., Norco, CA (US) 92860; Kenneth M. Lane, 2504 Palomino Dr., Covina, CA (US) 91724

( * ) Notice: Subject to any disclaimer, the term of this patent is extended or adjusted under 35 U.S.C. 154(b) by 528 days.

(21) Appl. No.: 10/963,396

(22) Filed: Oct. 11, 2004

(65) Prior Publication Data

US 2005/0082241 A1 Apr. 21, 2005

Related U.S. Application Data

(60) Provisional application No. 60/511,999, filed on Oct. 17, 2003.

(51) Int. Cl.
*F05B 73/00* (2006.01)

(52) U.S. Cl. ..... 211/4

(58) Field of Classification Search ..... 211/4, 211/64; 70/16, 62, 58; 312/216
See application file for complete search history.

(56) References Cited

U.S. PATENT DOCUMENTS 3,927,923 A * 12/1975 Kimmel ..... 312/125
4,132,315 A 1/1979 Young
4,174,042 A 11/1979 Fair
4,461,385 A * 7/1984 Clouser ..... 211/4
5,138,852 A 8/1992 Corcoran
5,579,923 A 12/1996 Hemmerlein
5,887,730 A 3/1999 St. George
6,619,082 B1 * 9/2003 Bentley ..... 70/58
6,868,975 B2 * 3/2005 Sells et al. ..... 211/4

* cited by examiner

*Primary Examiner*—Sarah Purol
(74) *Attorney, Agent, or Firm*—Merchant & Gould P.C.

(57) ABSTRACT

An apparatus for securely storing at least one firearm includes a firearm shackle having a mounting bracket for secure attachment to a fixed structure. A secure extension has a secured portion secured to the mounting bracket and a distant portion movable relative to said mounting bracket. A clasp has a closed state and an open state with the clasp sized to securely engage a grip end of a firearm when in the closed state and to release the grip end when in the open state. The clasp is connected to the distant portion of the extension for movement therewith. A releasable lock permits selective shifting of the clasp from the closed state to the open state. As an additional component, the apparatus may include a barrel retainer for releasably engaging a barrel end of said firearm. The secured portion and the distant portion of the extension may be separated by either a rigid or a flexible separation.

4 Claims, 6 Drawing Sheets

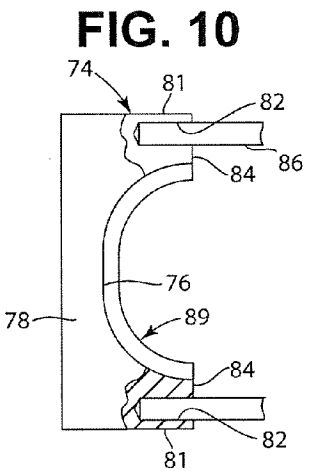
FIG. 10
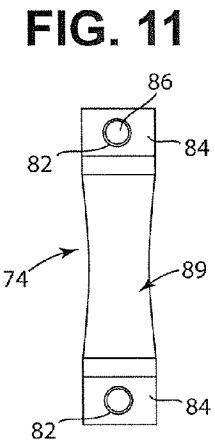
FIG. 11
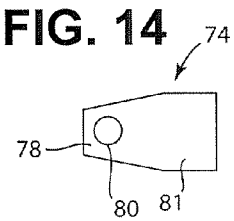
FIG. 14
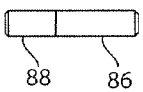
FIG. 15
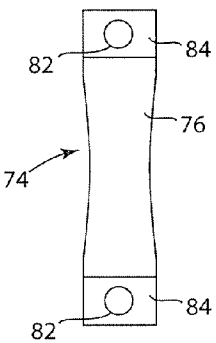
FIG. 12
FIG. 13
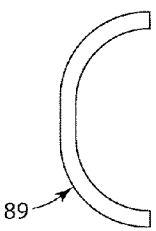
FIG. 16
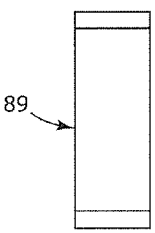
FIG. 17
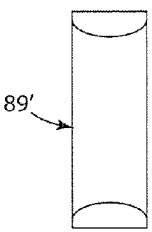
FIG. 18

HIGH SECURITY DISPLAY SYSTEM FOR RETENTION OF FIREARM

I. CROSS-REFERENCE TO RELATED APPLICATIONS

This patent application claims priority to U.S. Provisional Patent Application Ser. No. 60/511,999 filed Oct. 17, 2003 in the names of Woodrow Wilson Lane and Kenneth Michael Lane.

II. BACKGROUND OF THE INVENTION

1. Field of the Invention

This invention pertains to an apparatus for storing firearms. More particularly, this invention pertains to an apparatus for storing and displaying firearms in a manner to securely capture the firearm while permitting display of the firearm.

2. Description of Prior Art

Many owners of firearms prefer to display their firearm collection in their homes or businesses. Firearm display cabinets are available from a wide variety of sources and come in a wide variety of styles. These include inexpensive pine wood cabinets as well as exquisite, high quality, furniture-grade hardwood and glass systems. The primary function of traditional display cabinets is to provide an attractive display of an owner's firearm collection. Such cabinets provide only minimal security, which may include tempered glass and a low security lock.

Due to crime and concerns over child safety, increased attention has been placed on firearm security. Indeed, some jurisdictions legislate requirements for firearm safety. Legislative required storage may include metal safes or gun boxes. These are highly secure but sacrifice a visible and attractive display of a firearm collection.

It is an object of the present invention to provide a highly secure storage system for firearms while permitting their attractive display. The present invention provides a secure system for storing firearms with or without a surrounding cabinet. The present invention accommodates a wide range of firearm types. The design of the present invention is modular to accommodate a single firearm or multiple arms

III. SUMMARY OF THE INVENTION

An apparatus is disclosed for securely storing at least one firearm. The apparatus includes at least one firearm shackle having a mounting bracket for secure attachment to a fixed structure. A secure extension has a secured portion secured to the mounting bracket and a distant portion movable relative to said mounting bracket. A clasp has a closed state and an open state with the clasp sized to securely engage a grip end of a firearm when in the closed state and to release the grip end when in the open state. The clasp is connected to the distant portion of the extension for movement therewith. A releasable lock permits selective shifting of the clasp from the closed state to the open state. As an additional component, the apparatus may include a barrel retainer for releasably engaging a barrel end of said firearm. The secured portion and the distant portion of the extension may be separated by either a rigid or a flexible separation.

IV. BRIEF DESCRIPTION OF THE DRAWINGS

FIG. 10 is a side elevation view, partially in section, of one half of a clasp for the shackle of FIG. 3 (with an opposite half being substantially identical) and showing a retention pin in a bore of the clasp;

FIG. 11 is a front side elevation view of the clasp of FIG. 10;

FIG. 12 is a longitudinal sectional view of the clasp of FIG. 10 (and with a padding removed);

FIG. 13 is the view of FIG. 11 with a padding removed;

FIG. 14 is an end elevation view of the clasp of FIG. 12;

FIG. 15 is a retention pin for use in joining opposing clasps of FIG. 10;

FIG. 16 is a side elevation view of a padding for use in the clasp of FIG. 10;

FIG. 17 is a side elevation view of the padding of FIG. 16;

FIG. 18 is a side elevation view of a padding of alternative geometry to that of FIG. 17;

V. DETAILED DESCRIPTION OF THE PREFERRED EMBODIMENT

With reference now to the various drawing figures in which identical elements are numbered identically throughout, a description of the preferred embodiment of the present invention will now be provided.

Figure 1:
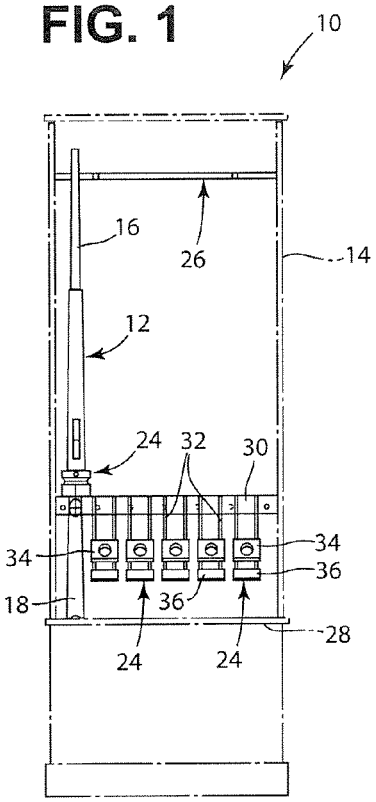
FIG. 1 is a front elevation view of a secure display system according to the present invention and shown in an embodiment for receiving and storing six rifles (with only one rifle shown in FIG. 1 for the purpose of clarity) and showing, in phantom lines, optional cabinetry surrounding the system.
Figure 2:
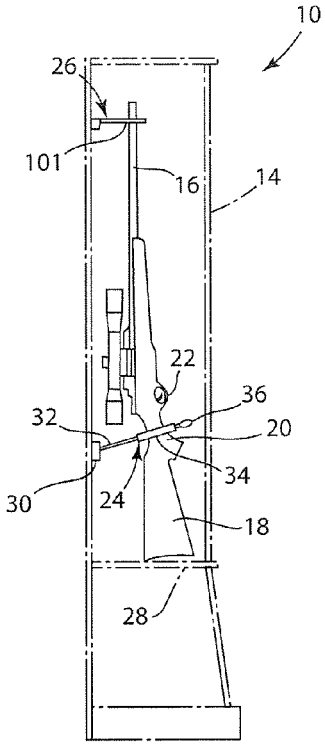
FIG. 2 is a side elevation view of the apparatus of FIG. 1 and showing, in phantom lines, optional cabinetry surrounding the system.

With initial reference to FIGS. 1-2, the apparatus of the present invention is shown in the preferred embodiment as a system 10 for receiving a plurality of firearms 12. In FIGS. 1-2, the firearm 12 is represented by a rifle or shotgun.

As will become apparent, the present invention can handle a wide variety of firearms (for example, long guns such as rifles and shotguns of various lengths and construction). Therefore, for ease of description, the term "firearm" is meant to include rifles, shotguns, carbines as well as multiple barreled firearms in various geometries (for example, over-and-under and side-by-side barrel geometries). Also, while the system 10 is shown as accommodating six rifles or shotguns, the system 10 is readily adaptable to secure only one such firearm or numbers less than or greater than the six shown in the figures.

In the embodiments of FIGS. 1 and 2, optional cabinetry features are shown in phantom lines 14. It will be appreciated that the apparatus 10 could be a stand-alone product, which may be affixed to a structure such as a wall of a building as will be described. Alternatively, a wide variety of cabinetry could be designed around the apparatus 10 of the present invention and could include cabinet quality wood panels or glass panels or any combination of such details to display the secured firearms 12 in an ornamental fashion.

As shown in FIGS. 1 and 2, the firearm 12 includes a barrel 16 and a stock end 18. A grip end 20 (FIG. 2) is positioned between the stock end 18 and barrel end 16 as is customary. The grip end 20 is the portion of the firearm normally gripped by the user when firing the firearm 12 and is adjacent the trigger area 22.

The apparatus 10 includes a firearm shackle 24 and a barrel retainer 26. The shackle 24 and retainer 26 will be described in greater detail. The shackle 24 and retainer 26 cooperate to securely fix the firearm 12 in place relative to a supporting structure such as a building wall (not shown). A shelf 28 is shown in phantom lines to permit the stock end 18 of the firearm 12 to rest against the shelf 28.

As shown in FIG. 1, a separate shackle 24 is provided for each firearm to be stored in the apparatus 10. A mounting bracket 30 contains each shackle 24 secured to the wall (not shown) of the building to which the apparatus 10 is affixed.

Figure 3:
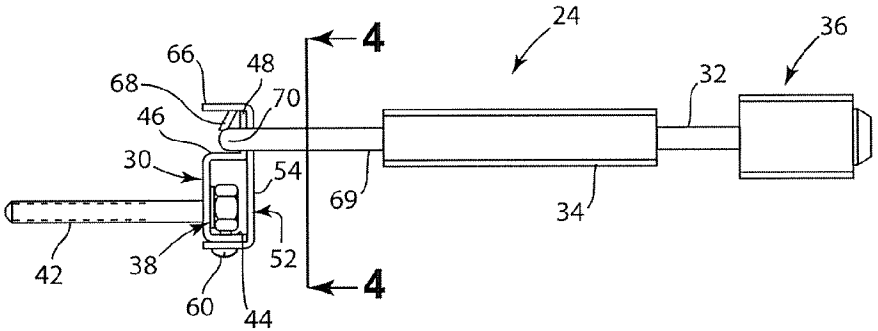
FIG. 3 is a side elevation of a firearm shackle according to a first embodiment of the present invention.

As shown in FIG. 3, each shackle 24 includes an extension member 32 extending from the mounting bracket 30. Further, each shackle 24 includes a clasp 34 carried on the extension member 32. As shown in FIGS. 1-2, the clasp 34 is sized to securely engage the grip 20 of the firearm 12. A lock block 36 releasably secures each of the clasps 34 to their respective extension members 32.

Figure 4:
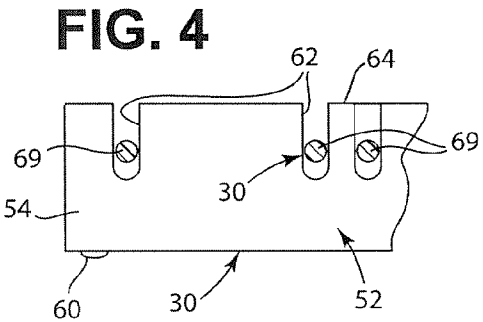
FIG. 4 is a view taken along line 4-4 of FIG. 3.
Figure 5B:
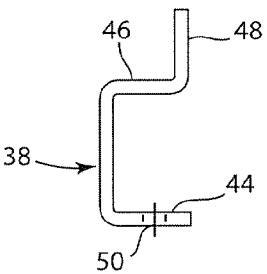
FIG. 5B is a side elevation view of the mounting bracket of FIG. 5.
Figure 5:
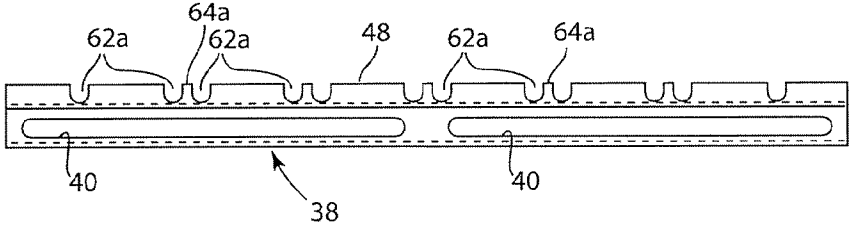
FIG. 5 is a front elevation view of a mounting bracket of the shackle of FIG. 3.

Shown best with reference to FIGS. 3 through 5, the mounting bracket 30 includes a rear wall 38 for placement against a wall (not shown) of a fixed structure such as a building. The rear wall 38 has a plurality of slots 40 formed through the wall 38. The elongated slots 40 permit the rear wall 38 to be positioned against the wall of a building and be affixed to the building through any suitable mechanism such as lag screws 42 (shown in phantom lines in FIG. 3).

Figure 5A:
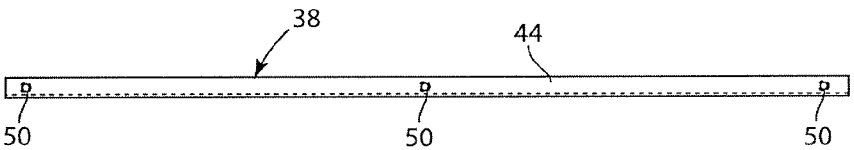
FIG. 5A is a bottom plan view of the mounting bracket of FIG. 5.

Extending perpendicularly away from the rear wall 38 are lower and upper walls 44, 46. A slotted plate 48 extends upwardly from the upper wall 46. The slotted plate 48 is spaced from rear wall 38 by an amount sufficient to receive an extension member 32 as illustrated in FIG. 3. The lower wall 44 is provided with holes 50 (FIG. 5A) which are threaded to receive tamper-resistant fasteners 60 (FIG. 4).

With reference now to FIGS. 3, 4 and 6-8, a cover 52 is shown coupled to the rear wall 38 to form the mounting bracket 30. The cover 52 includes a front plate 54 and a rearward extending bottom wall 56. The bottom wall 56 has holes 58 positioned to align with holes 50 (FIG. 5A) when the cover 52 is positioned with the bottom wall 56 in parallel engagement against bottom wall 44 (as shown in FIG. 3). Tamper-resistant fasteners 60 secure the walls 44 and 56 together. The walls 44, 56, 38, 46 and 54 cooperate to define a pocket, which receives the head of the lag screw 42 and prevents unauthorized access to remove the lag screw 42.

Figure 6:
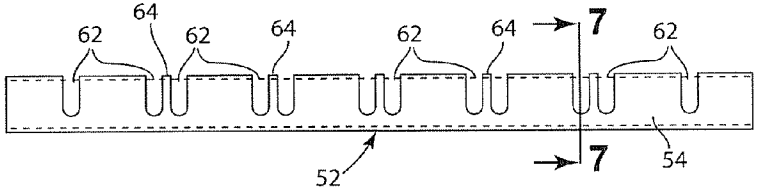
FIG. 6 is a front elevation view of a mounting bracket cover.
Figure 8:
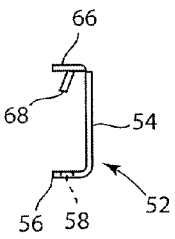
FIG. 8 is a side elevation view of the cover of FIG. 6.

The slotted plate 48 (FIG. 5) and the front plate 54 (FIG. 6) have aligned slots 62*a*, 62. As shown in FIGS. 4 and 6, the aligned slots 62 are paired to receive both bars (as will be described) of the extension member 32. The paired slots 62 are separated by narrow dividers 64*a*, 64 (FIG. 6).

Figure 7:
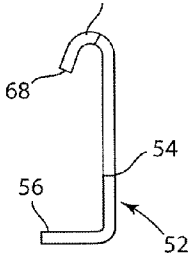
FIG. 7 is a view taken along line 7-7 of FIG. 6.
Figure 8A:
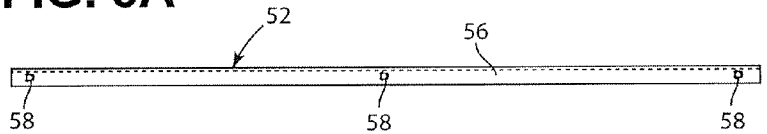
FIG. 8A is a bottom plan view of the mounting bracket of FIG. 6.
Figure 21:
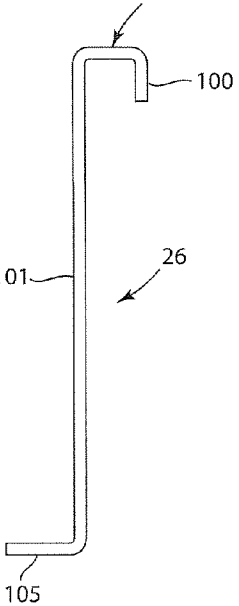
FIG. 21 is a side elevation view of the barrel retainer of FIG. 19.
Figure 24:
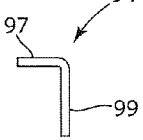
FIG. 24 is a side elevation view of the cover of FIG. 22.
Figure 19:
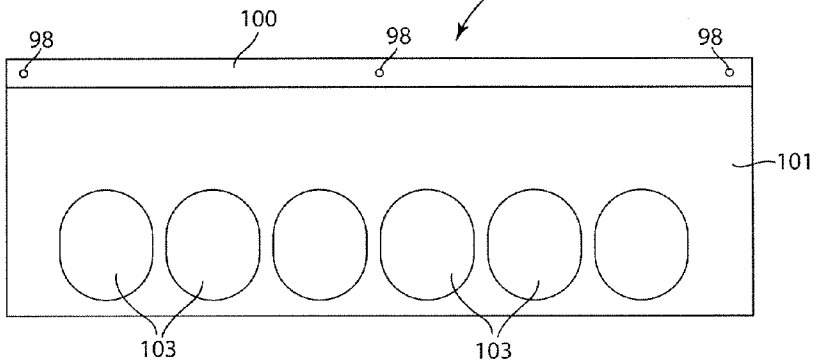
FIG. 19 is a top plan view of a barrel retainer.
Figure 20:
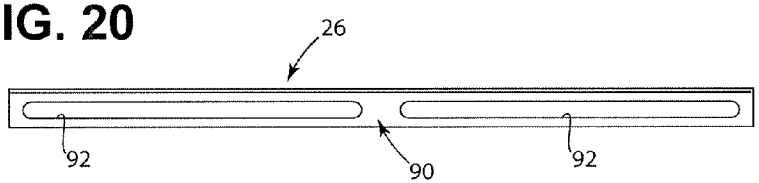
FIG. 20 is a view taken along line 20-20 of FIG. 19.
Figure 22:
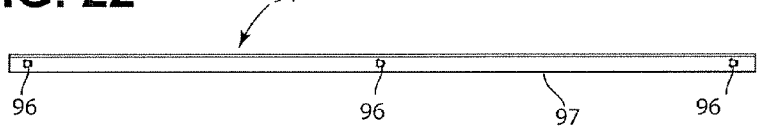
FIG. 22 is a top plan view of a cover for the barrel retainer of FIG. 19.
Figure 23:
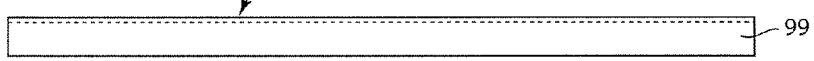
FIG. 23 is a front elevation view of the cover of FIG. 22.

Wall 54 has a rearward extending upper wall 66 that projects rearward a distance to abut the wall (not shown) against which wall 38 is abutting such that wall 66 has a depth approximately equal to that of upper wall 46 (see FIG. 3). As illustrated in FIG. 7, at the narrow dividers 64, the upper wall 66 is bent downwardly in an arcuate or curved manner as illustrated at numeral 68 in FIG. 7 to positively engage wall 54 with slotted plate 48.

Figure 9:
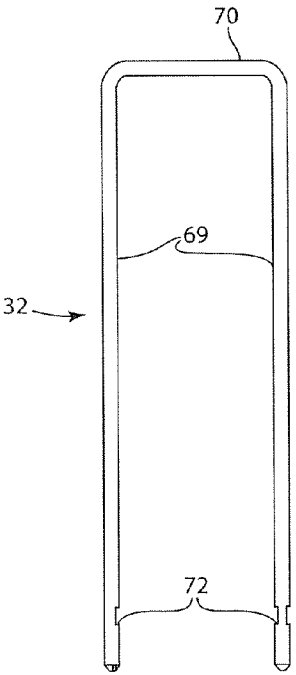
FIG. 9 is a plan view of an extension member for the firearm shackle of FIG. 3.

The extension member 32 is separately shown in FIG. 9. Extension member 32 includes two parallel slide bars 69 joined by a rear bar 70. As shown in FIGS. 3 and 4, the slide bars 69 are received within the slots 62 and the rear bar 70 is received within the space defined by the upper walls 46, 66, upper plate 48 and the wall (not shown) of the structure to which the mounting bracket 30 is affixed.

The slots 62 have a depth sufficient for the rear bar 70 to abut the upper wall 46 (as shown in FIG. 3) while maintaining a spacing between the rear bar 70 and the upper wall 62. As a result, the extension member 32 may pivot (generally about the axis of rear bar 70) between a horizontal position shown in FIG. 3 and a downward position (illustrated by the five shackles 24 shown in the right-hand side of FIG. 1).

The steel construction of the cover 52 and rear wall 38 and the tamper-resistant fasteners 60 prevent unauthorized removal of the extension member 32 from the mounting bracket 30. In assembly, the rear wall 38 is secured to a building structure by lag screw 42. The extension member 32 is placed within the slots 62 of the cover 52 and the combination cover 52 and extension member 32 are assembled on to the rear wall 38 and secured thereto by the tamper-resistant fastener 60.

So secured, the bar 70 is a secured portion of the shackle 24 secured to the mounting bracket 30. The slide bars 69 are distant portions of the shackle 24 and which are movable relative to the mounting bracket 30. Near the free end of the slide bars 69 opposing slots 72 are formed for reasons that will be described.

As mentioned, the grip 20 of the firearm 12 is securely grasped by a clasp 34. The clasp 34 is formed by coupling adjacent halves or cup assemblies 74 (FIGS. 10-18).

The cup assembly 74 is formed from a block of steel having a U-shaped recess 76. While steel is described, any strong construction is acceptable. A rear wall 78 has a smooth bore 80 formed there through and sized to slidably receive the slide bars 69. Sidewalls 81 have partial bores 82 extending inwardly from a front wall 84. The bores 82 are perpendicular to the axis of the bore 80. The U-shaped recess 76 is a concave recess formed in the front wall 84.

An alignment pin 86 is shown in FIG. 15 as having a knurled end 88 to be press fit into the bores 82. FIG. 10 shows one such pin 86 in bore 82. Both such bores 82 could have a pin 86 which could then have their exposed ends slidably received with aligned bores 82 of a second cup assembly 84 which, when coupled, form a completed clasp 34. As shown in FIG. 10, a clasp 34 is formed of two identical assemblies 74 each having one pin 86 to avoid need of an inventory of separate right-and left-hand assemblies 74.

The U-shaped recess 76 is lined with a padding 89 (shown in FIGS. 10 and 11 and 16 and 17), which conforms to the U-shape of the recess 76 and provides a resilient non-abrasive surface to contact the grip 20 of the firearm 12. FIG. 18 shows an alternative cross-sectional geometry of a padding 89'.

With the structure thus described, the cup assemblies 74 may be placed on the grip 20 of the firearm 12 by taking two cup assemblies 74 placed on opposite sides of the grip 20 and with the grip 20 received within opposing recesses 76. The pads 88 protect the wood or other material of the grip area 20 from injury or damage. Pins 86 can be placed in the aligned and opposing bores 82. It will be appreciated that while one end of the pin 86 is press fit within a cup assembly 74 the other end is slidably received within the bore 82 of an opposing cup assembly 74.

With the cup assemblies 74 so joined, they form a single clasp 34. The clasp 34 can then be slid onto the extension 32 by slidably passing the slide bars 69 through aligned bores 80 of the opposing cup assembly 74. The lock block 36 (as will be described in detail) is secured to the free ends of the slide bar 68 to prevent unauthorized removal of the clasp 34 from the extension 32.

Before proceeding with a detailed description of the lock block 36, the barrel retainer 26 will now be described with reference to FIGS. 1, 2 and 20-24. A rear wall 90 of the retainer 26 has slots 92 formed therein for passing of lag screws or other fasteners through the slots 90 and securely affixing the wall 90 to the wall of a structure as previously described with reference to the mounting bracket 30.

An L-shaped cover 94 is provided with holes 96 in a top wall 97 aligned with holes 98 in a top wall 100 of the retainer 26. When joined to the retainer 26 with the holes 96 aligned with holes 98, a front wall 99 of the L-shaped cover 90 cooperates with the retainer 26 to define a pocket to protect the head of a lag screw from tampering in the manner similar to that described with reference to mounting bracket 30. Tamper-resistant fasteners can be passed through the aligned holes 96, 98 to securely fasten the elements. It will be appreciated that the embodiment of FIGS. 1 and 2 does not show an L-shaped cover 94 but shows an optional embodiment of having a mounting bracket secured to a wall with fasteners exposed.

The retainer 26 includes a plate 101 extending perpendicularly away from the wall 90. The plate 101 presents a downward facing ornamental front plate 105 (not shown in FIGS. 1 and 2). The plate 101 has a plurality of openings 103 sized to receive the barrel 16 of the firearm 12. The holes 103 are sized greater than the diameter of the barrel 16 and permit play and movement within the holes 103. Preferably, the holes 103 can be lined with a padding (not shown) similar to the padding 88 lining the cup assembly 74. The barrel retainer 26 and shackle 24 are positioned a distance apart to prevent removal of the barrel from the holes 103 when the firearm grip 20 is retained within the clasp 34 as shown in FIG. 2.

Figure 25:
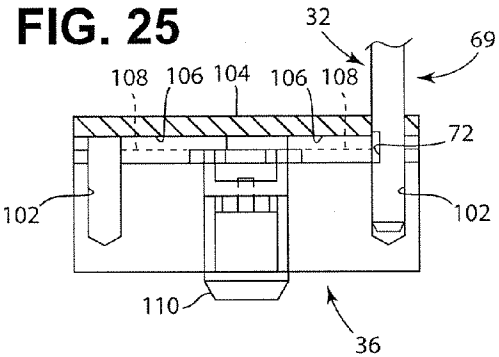
FIG. 25 is a longitudinal sectional view of a locking block according to the present invention and showing interior locking elements.
Figure 26:
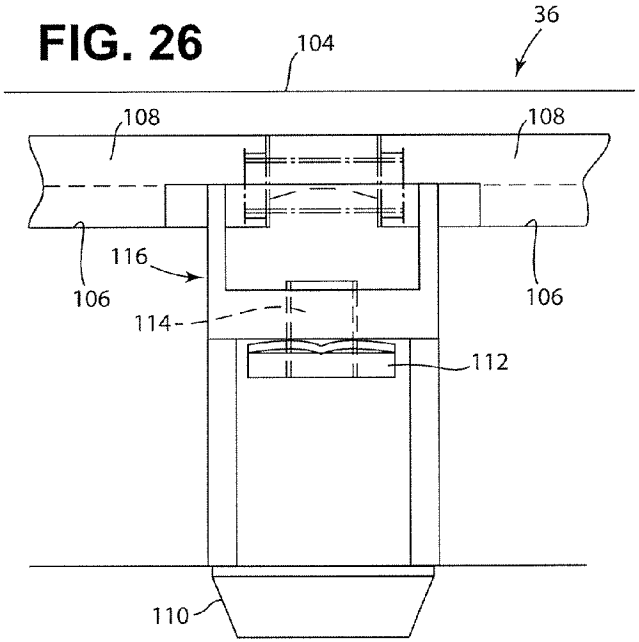
FIG. 26 is an enlarged view of a locking feature for the locking block of FIG. 25.

FIGS. 25 and 26 illustrate the lock block 36. The block 36 is a steel (or any other strong material) block having bores 102 extending partially through from a rear wall 104. The bores 102 are sized such that when the free ends of the slide bars 69 (only one of which is shown in FIG. 25) are placed within the bores 102, the slots 72 are aligned with a bore 106 transversely extending between the bores 102.

Lock pins 108 are slidably received within the bore 106 and positioned to slide along their axes into the slots 72. Accordingly, when the pins 108 are positioned within the slots 72, the pins prevent removal of the lock block 36 from the slide bars 68. A spring 109 is provided to urge the pins 108 into the slots 72.

A lock assembly 110 is positioned within the block 36. It will be appreciated that any commercially available locking mechanism could be used to be key-actuated to cause the lock pins 108 to move into or out of the slots 72 at the option of an operator by turning a key within the lock assembly 110. For example, in the embodiment shown, the lock 110 includes a barrel 112 housing a pin 114 for turning by an operator with a key.

The pin 114 is coupled to a hollow, elliptical cam 116. A spring washer 111 urges the cam 116 into engagement with pins 108. As the cam 116 rotates, diametrically opposite internal minor diameter of the elliptical cam 166 urges the pins 108 out of the slots 72 against the bias of the spring 109. A spring 109 is provided to urge the pins into the slots 72 such that the lock block 36 need not be manually placed into a lock position but would automatically be placed into a locked position when placed on the slide bars 69. In this embodiment, a key is only required to unlock the block 36 and remove it from the slide bars 69.

In the previously described figures, the clasp 34 was held spaced from the mounting bracket 30 by rigid extension member 32. It will be appreciated that the extension member could be flexible as illustrated in FIGS. 27-29 (in which elements in common with previously described components are numbered identically with the addition of an apostrophe to distinguish the embodiments).

Figure 28:
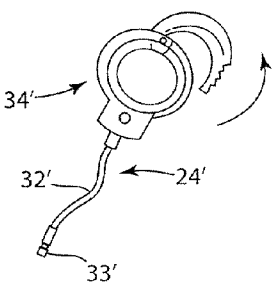
FIG. 28 is a view of a clasp for use in the embodiment of FIG. 27.
Figure 29:
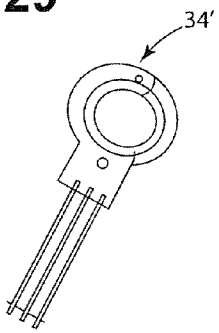
FIG. 29 is a top plan view of an alternative clasp for use in the embodiment of FIG. 27.
Figure 27:
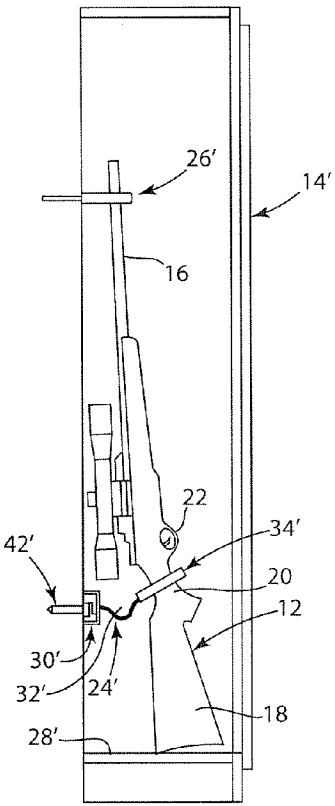
FIG. 27 is a view similar to that of FIG. 2 and showing an alternative embodiment of the present invention.

In FIGS. 27 and 28, the clasp 34' is shown as a traditional hand cuff sized to be received around the grip 20 of the firearm 12, the extension member 32' is a flexible steel cable connected to the mounting bracket 30'. FIG. 29 shows a still further embodiment where the clasp 34' would be connected to the mounting bracket 30' by rigid bars 32" one end of which is pivotally connected to the cuff 34' and with an opposite end pivotally connected to a mounting bracket 30. Each cable cuff 32' has a groove 33' at the opposite end of the cable 32' which aligns with slotted holes in the mounting bracket 30'. The cable 32' is a high strength composite assembly designed for high security applications.

The barrel retainer 26 may be formed of heavy gauge sheet metal or high impact plastic. It is bent and slotted as described to provide a means of mounting to a wall or the inside of a cabinet. The padded holes 103 accept the firearm barrel 16 and restrain movement of the barrel 16. This augments the primary security provided by the shackle 24. The firearms 12 are fully secured by the firearm shackle assembly 24. However, without the barrel retainer 26, a perspective thief could use the leverage of a loose barrel 16 to attempt to defeat the shackles 24 resulting in damage to the firearm 12 and possible fracture of the stock 18 of the firearm 12.

The structure described creates a secure firearm display. The display system permits two directions of motion to accommodate different firearm geometries. The system includes a primary security (e.g., the shackles connected by lag screws through the mounting bracket to a structure) and a secondary security (e.g., covers retained by tamper-resistant fasteners) to protect the primary system. Having described the present invention in a preferred embodiment, it will be appreciated that modifications and equivalents may readily occur to one skilled in the art. It is intended that such modifications and equivalents shall be included within the scope of the claims, which are appended hereto.

We claim:

1. An apparatus for securely storing at least one firearm, said firearm having a barrel end and a grip end, said apparatus comprising:

at least one firearm shackle including:

a mounting bracket for secure attachment to a fixed structure;

a secure extension having a secured portion secured to said mounting bracket and a distant portion movable relative to said mounting bracket;

a clasp having a closed state and an open state with said clasp sized to securely engage said grip end of a firearm when in said closed state and to release said grip end when in said open state;

said clasp connected to said distant portion of said extension for movement therewith;

a releasable lock for selectively permitting shifting of said clasp from said closed state to said open state; and wherein said secured portion and said distant portion of said extension are separated by a flexible separation.

2. An apparatus for securely storing at least one firearm, said firearm having a barrel end and a grip end, said apparatus comprising:

at least one firearm shackle including:

a mounting bracket for secure attachment to a fixed structure;

a secure extension having a secured portion secured to said mounting bracket and a distant portion movable relative to said mounting bracket;

a clasp having a closed state and an open state with said clasp sized to securely engage said grip end of a firearm when in said closed state and to release said grip end when in said open state;

said clasp connected to said distant portion of said extension for movement therewith;

a releasable lock for selectively permitting shifting of said clasp from said closed state to said open state;

wherein said secured portion and said distant portion of said extension are separated by a rigid separation;

said extension including a slide mechanism including said secured portion and said distant portion;

said clasp slidably mounted on said slide mechanism at said distant portion and slidably removable from a free end of said slide bar;

said lock disposed to prevent removal of said clasp from said slide bar when said lock is in a locked state.

3. An apparatus according to claim 1 further comprising:

said slide mechanism includes first and second spaced apart slide bars;

said clasp including first and second brackets, each sliding mounted on respective ones on said first and second slide bars;

said first and second brackets having opposing surfaces defining a pocket when said brackets are aligned in opposition;

said opposing surfaces defining a pocket sized to receive said grip of said firearm.

4. An apparatus according to claim 2 wherein said lock includes a blocking member releasably secured to free ends of said slide bars.

* * * * *